US010495426B2

(12) United States Patent
Haas

(10) Patent No.: US 10,495,426 B2
(45) Date of Patent: Dec. 3, 2019

(54) BROADHEAD HAVING BOTH PIVOTING AND FIXED BLADES

(71) Applicant: FeraDyne Outdoors LLC, Superior, WI (US)

(72) Inventor: Matthew Peter Haas, Duluth, MN (US)

(73) Assignee: FeraDyne Outdoors, LLC, Superior, WI (US)

( * ) Notice: Subject to any disclaimer, the term of this patent is extended or adjusted under 35 U.S.C. 154(b) by 0 days.

(21) Appl. No.: 16/027,474

(22) Filed: Jul. 5, 2018

(65) Prior Publication Data

US 2019/0219372 A1 Jul. 18, 2019

Related U.S. Application Data

(63) Continuation of application No. 29/634,141, filed on Jan. 18, 2018.

(51) Int. Cl.
*F42B 6/08* (2006.01)

(52) U.S. Cl.
CPC ..... *F42B 6/08* (2013.01)

(58) Field of Classification Search
CPC ..... F42B 6/08
See application file for complete search history.

(56) References Cited

U.S. PATENT DOCUMENTS

| | | | | |
|---|---|---|---|---|
| 5,458,341 | A * | 10/1995 | Forrest | F42B 6/08 473/583 |
| 6,322,464 | B1 * | 11/2001 | Sestak | F42B 6/08 473/583 |
| 7,377,869 | B2 * | 5/2008 | Wohlfeil | F42B 6/08 473/583 |
| 8,974,327 | B2 * | 3/2015 | Priore | F42B 6/08 473/583 |
| 8,986,141 | B2 * | 3/2015 | Pedersen | F42B 12/34 473/583 |
| 2003/0073525 | A1 * | 4/2003 | Liechty, II | F42B 6/08 473/583 |
| 2006/0084535 | A1 * | 4/2006 | Kuhn | F42B 6/08 473/583 |
| 2018/0128584 | A1 * | 5/2018 | Beck | F42B 6/08 |

* cited by examiner

*Primary Examiner* — John A Ricci
(74) *Attorney, Agent, or Firm* — Greenberg Traurig, LLP; Dipak J. Shah

(57) ABSTRACT

A non-limiting exemplary embodiment of a broadhead includes a ferrule having a multi-faceted tip, a plurality of cutting blades fixedly attached to the ferrule, and a plurality of deployable blades coupled to the ferrule.

26 Claims, 15 Drawing Sheets

BROADHEAD HAVING BOTH PIVOTING AND FIXED BLADES

CROSS-REFERENCE TO RELATED APPLICATIONS

This application is a continuation of U.S. Design patent application Ser. No. 29/634,141 filed Jan. 18, 2018, which is herein incorporated by reference in its entirety.

STATEMENT REGARDING FEDERALLY SPONSORED RESEARCH OR DEVELOPMENT

Not applicable.

TECHNICAL FIELD

The instant disclosure relates to broadheads having both deployable and fixed cutting blades.

BACKGROUND

A wide range of arrowhead designs suitable for archery are commercially available. One category of arrowheads is the broadhead—a bladed arrowhead featuring multiple sharp cutting blades that are designed to greatly increase the effective cutting area of the arrowhead when it impacts a target. Broadheads are popular in the bowhunting industry, as the increased cutting radius of a broadhead results in larger entrance and exit wounds in a game animal struck by the broadhead, causing increased blood loss which kills the animal quickly and humanely, and provides a better blood trail for tracking and retrieval of the carcass.

While broadheads provide an improved cutting capability when compared to non-bladed field point or nib point arrowheads, some broadhead designs suffer from inferior aerodynamic properties in comparison with their non-bladed counterparts. The blades of the broadhead, if deployed during the flight of an arrow, can result in undesirable effects and cause the arrow to veer off course from the flight path.

Prior art broadhead designs have attempted to resolve the aerodynamic issues by retaining, at least in part, the deployable cutting blades of the broadhead within the ferrule body of the broadhead during flight. Upon impacting the target, the blades are deployed, moving outwardly from the ferrule body and exposing the sharp cutting edges of the blades once fully deployed. Such designs are known by those skilled in the art as an "expandable broadhead." Some prior art expandable broadheads are disclosed in U.S. Pat. Nos. 8,197,367 and 8,986,141, which are hereby incorporated by reference.

FIG. 1 illustrates one such prior art expandable broadhead 100 having two deployable blades 105*a* and 105*b*. A retaining device 120 is provided for retaining the deployable blades 105*a* and 105*b* in a retracted configuration within a ferrule body 110. The expandable broadhead 100 includes a two-sided "cut-on-contact" tip 115, which is a sharpened double-edged piece of steel inserted within the ferrule body 110, and is designed to penetrate the hide of a target game animal while requiring a relatively small amount of energy for penetration.

SUMMARY

A non-limiting exemplary embodiment of a broadhead includes a ferrule, one or more cutting blades attached to the ferrule, and a plurality of deployable blades rotatably attached to the ferrule. In some embodiments, the ferrule includes a multi-faceted tip and at least one blade recess. In certain embodiments, each of the plurality of deployable blades include a leading edge and a sharp cutting edge. In some embodiments, at least a portion of each deployable blades resides in at least a portion of the at least one blade recess.

DETAILED DESCRIPTION

One or more non-limiting embodiments are described herein with reference to the accompanying drawings, wherein like numerals designated like elements. It should be clearly understood that there is no intent, implied or otherwise, to limit the disclosure to the illustrated and described embodiments. While several non-limiting exemplary embodiments are described, variations thereof will become apparent or obvious. Accordingly, any and all variants having structures and functionalities similar to those of the illustrated and described embodiments are considered as being within the metes and bounds of the instant disclosure.

Figure 2A:
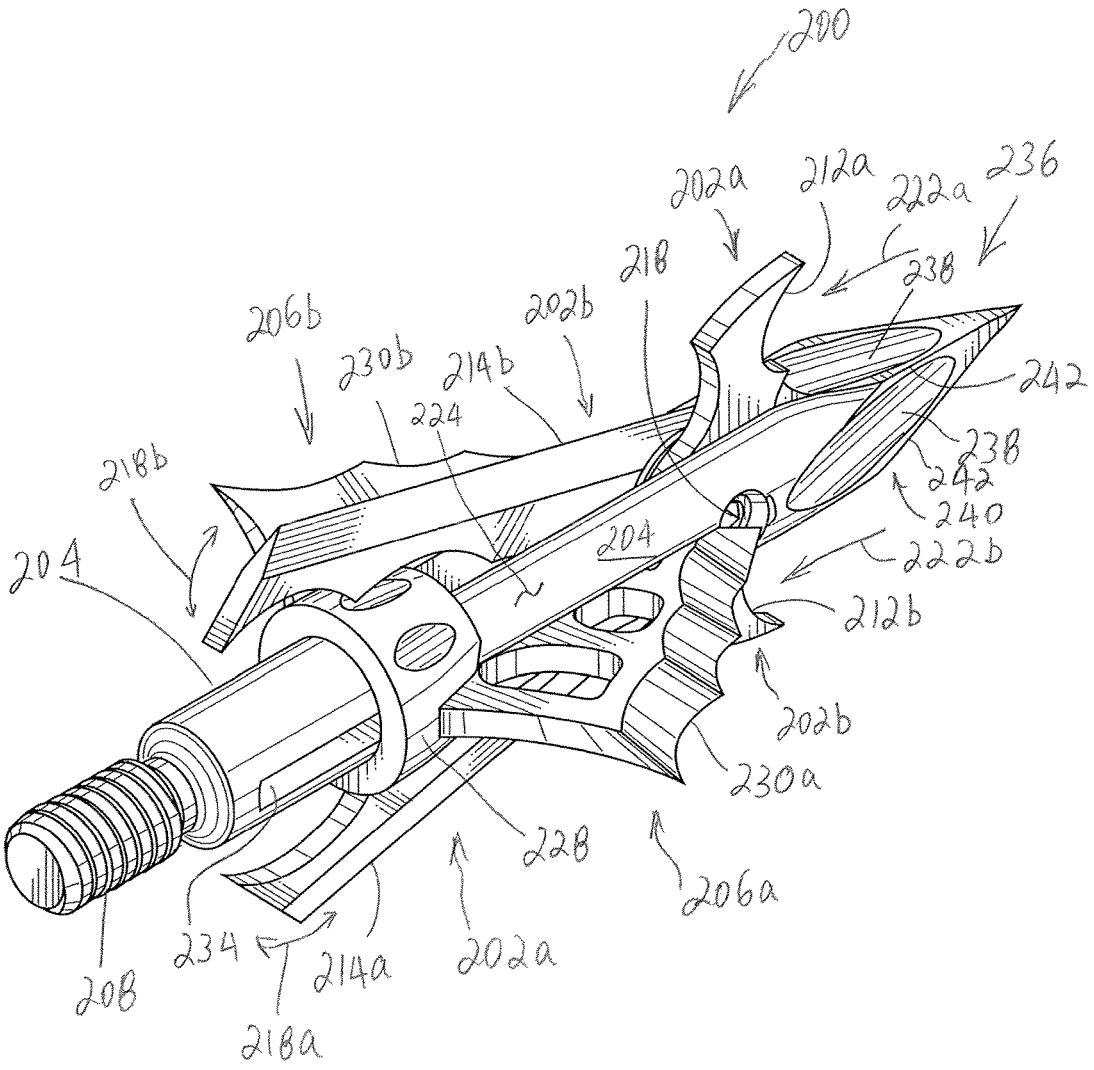
FIG. 2A is a perspective view of a non-limiting exemplary embodiment of a broadhead having deployable blades illustrated in a fully retracted state.
Figure 2B:
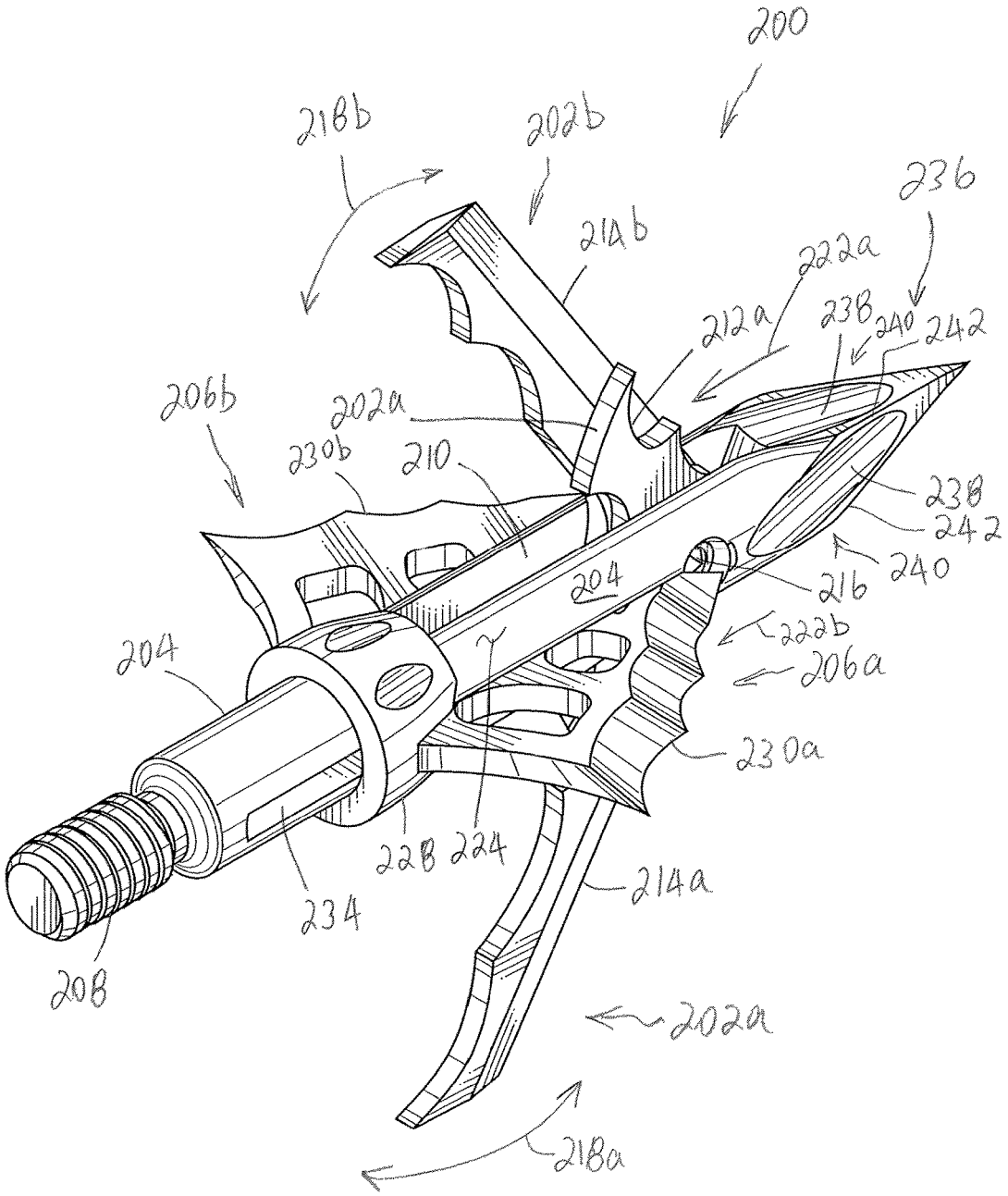
FIG. 2B is a perspective view of the broadhead of FIG. 2A with the deployable blades illustrated in a partially deployed (or partially extended) state.
Figure 3:
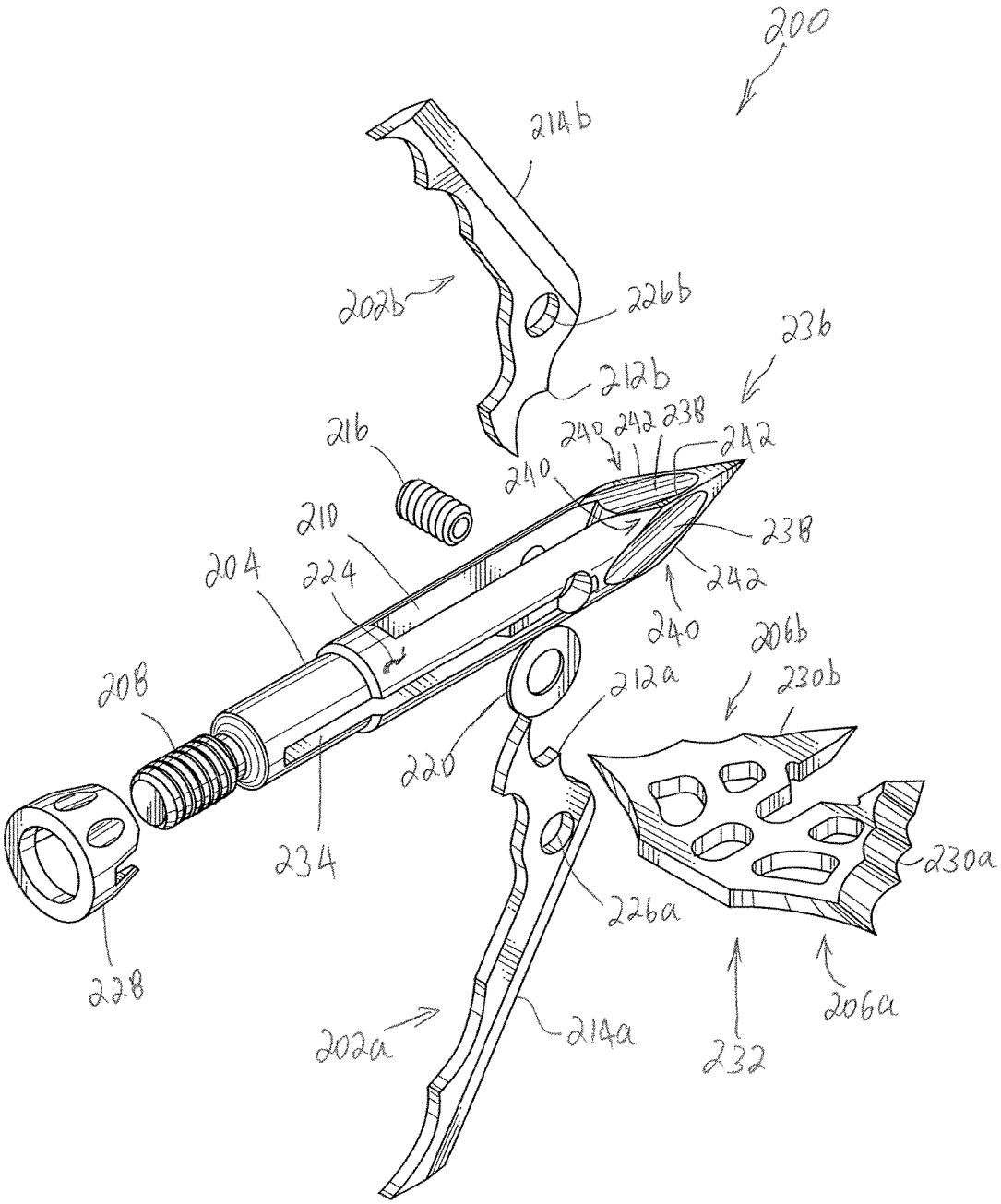
FIG. 3 is a perspective view of the broadhead of FIG. 2A in a dis-assembled state.
Figure 4A:
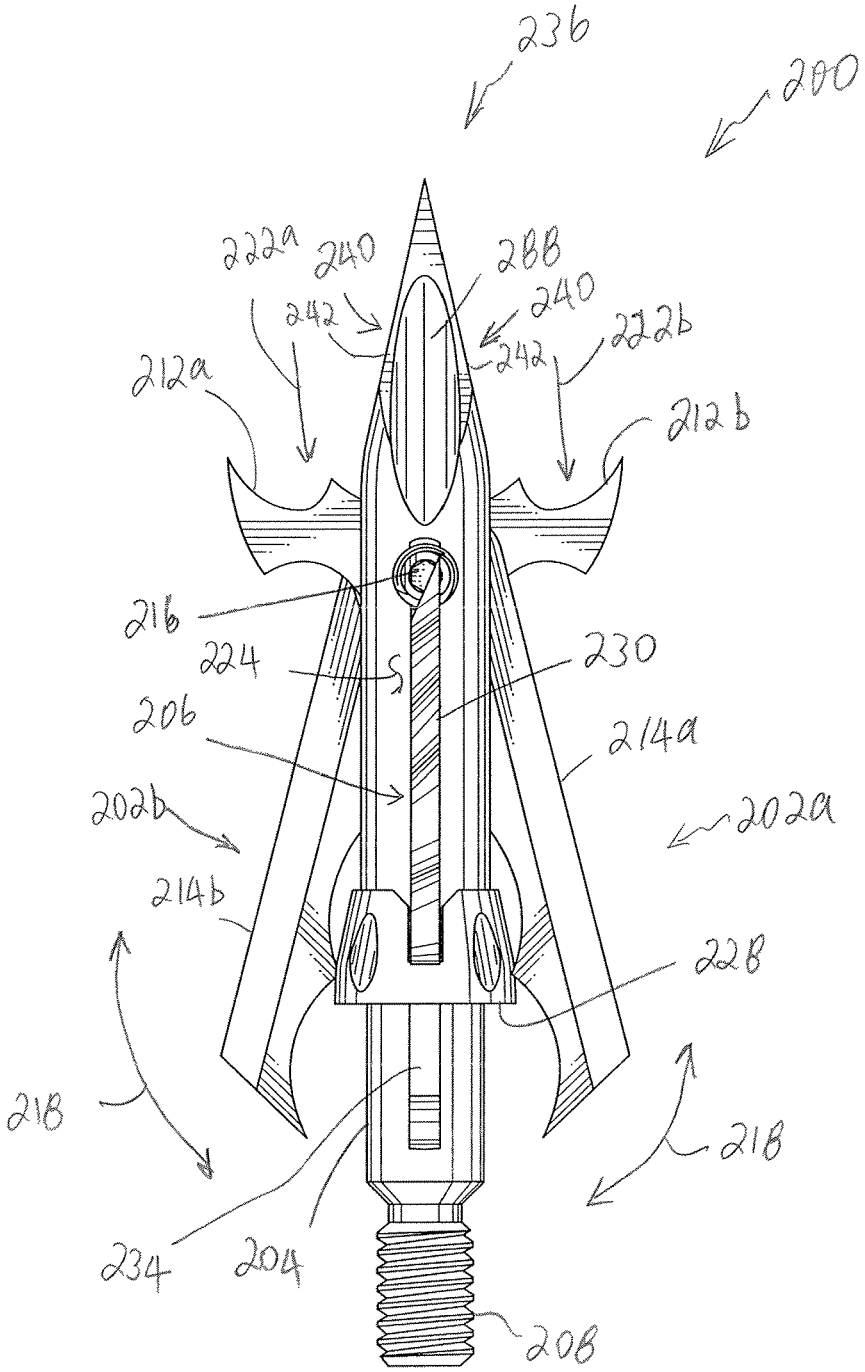
FIG. 4A is a side view of the broadhead of FIG. 2A.
Figure 4B:
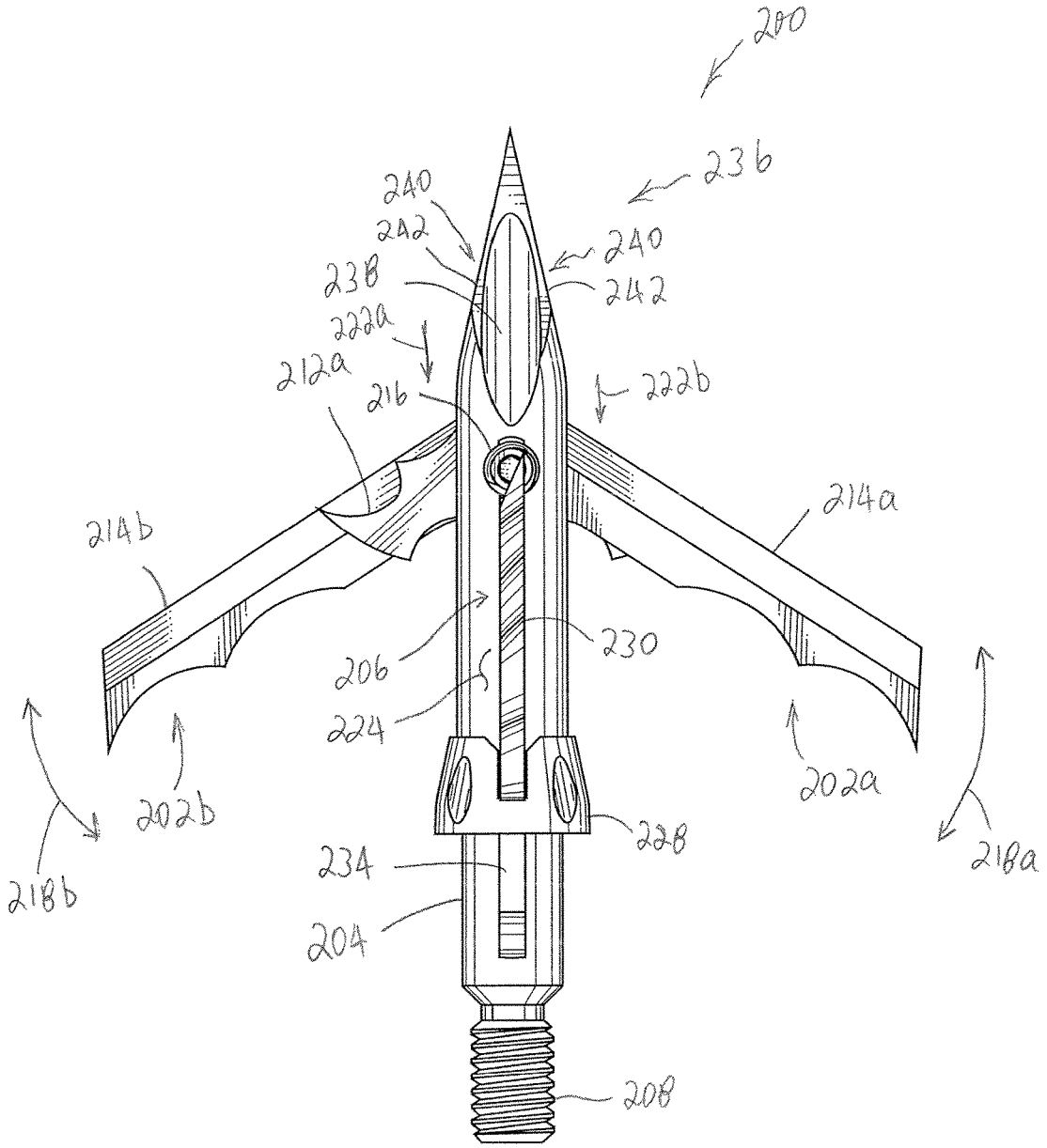
FIG. 4B is a side view of the broadhead of FIG. 2B.
Figure 4C:
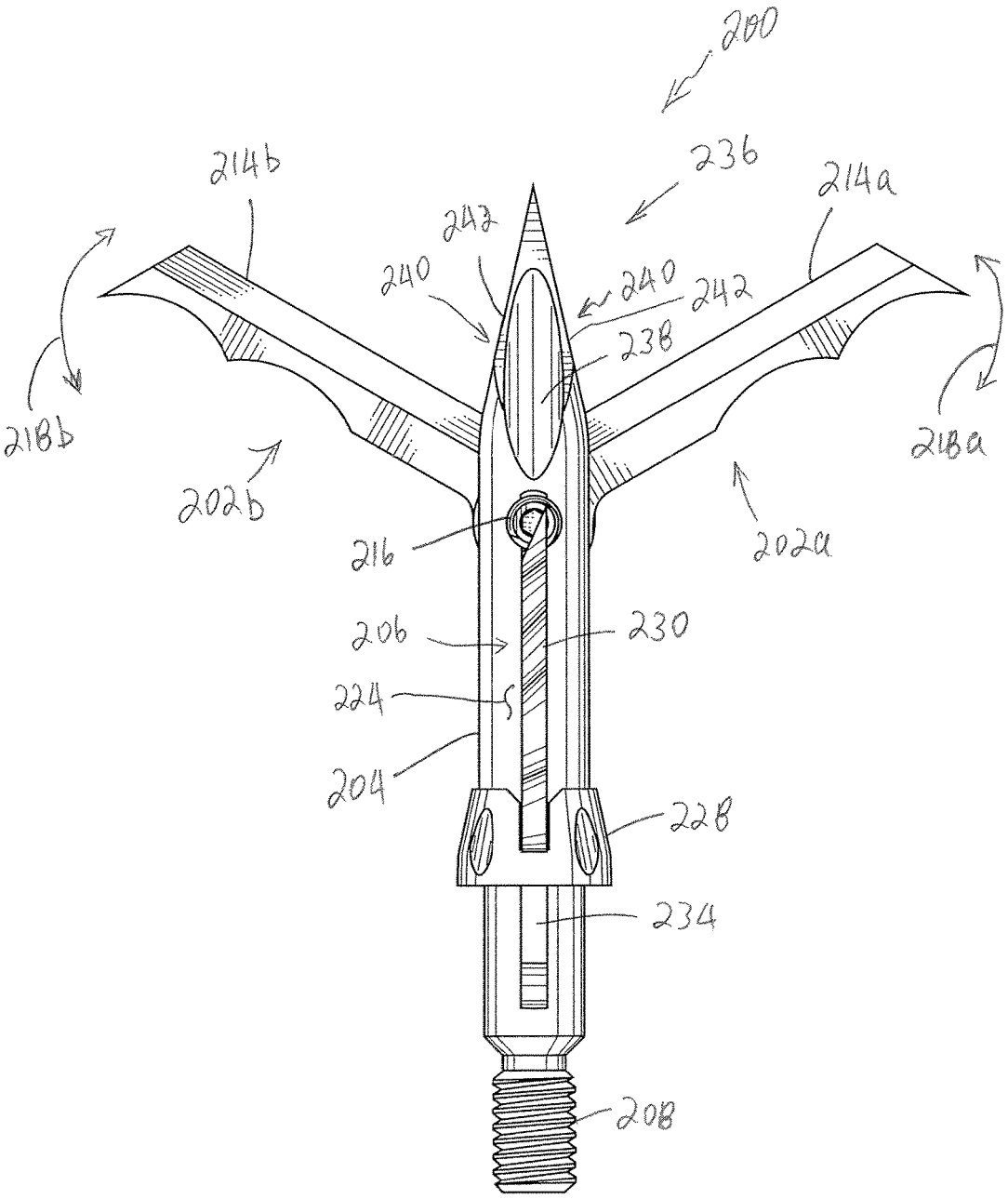
FIG. 4C is a side view of the broadhead of FIGS. 4A and 4B with the deployable blades illustrated in a fully extended state.
Figure 5:
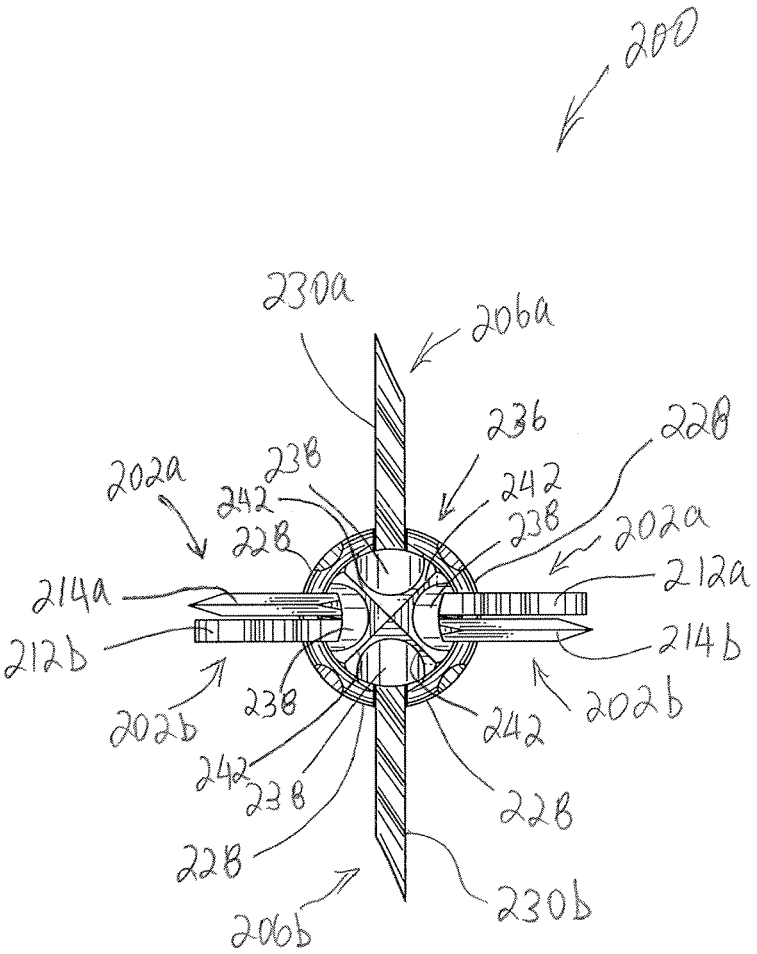
FIG. 5 is a front view of the broadhead of FIG. 2A.

FIGS. 2A and 2B are perspective views of a non-limiting exemplary embodiment of a broadhead 200. FIG. 2A illustrates the broadhead 200 with deployable blades 202*a* and 202*b* (collectively "deployable blades 202") in a fully retracted state; and FIG. 2B illustrates the broadhead 200 with the deployable blades 202 in a partially deployed (or partially extended) state. FIG. 3 is a perspective view of the broadhead 200 in a dis-assembled state illustrating non-limiting exemplary embodiments of some of the primary components thereof. FIGS. 4A-4C are side views of the broadhead 200 illustrating the deployable blades 202 in states or stages between fully retracted and fully extended (or fully deployed). FIG. 4A illustrates the broadhead 200 with deployable blades 202 in a fully retracted state; FIG. 4B illustrates the broadhead 200 with the deployable blades 202 in a partially deployed (or partially extended) state; and FIG. 4C illustrates the broadhead 200 with the deployable blades 202 in a fully extended (or fully deployed) state. FIG. 5 is a front view of the broadhead 200 of FIG. 2A (and FIG. 4A)

Figure 6A:
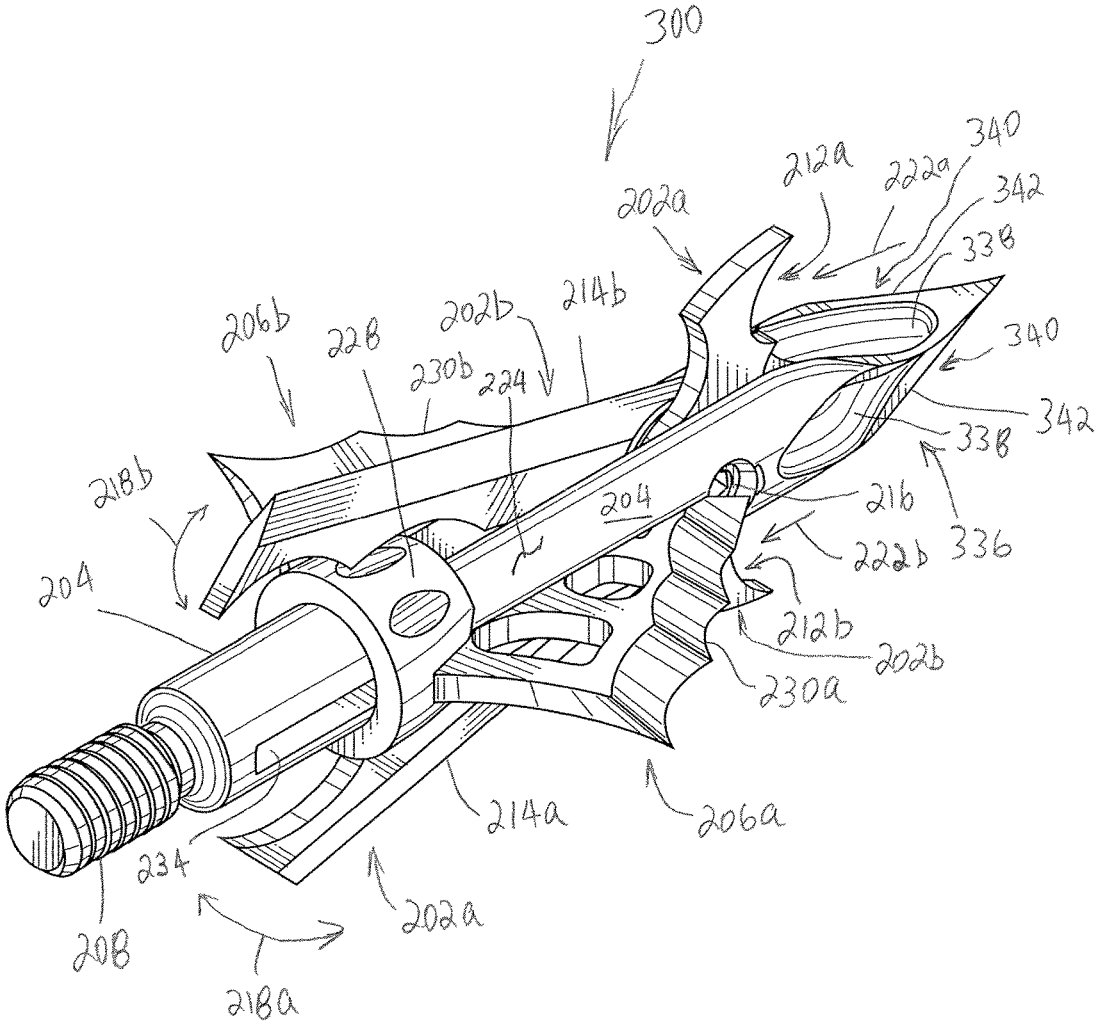
FIG. 6A is a perspective view of another non-limiting exemplary embodiment of a broadhead having deployable blades illustrated in a retracted state.
Figure 6B:
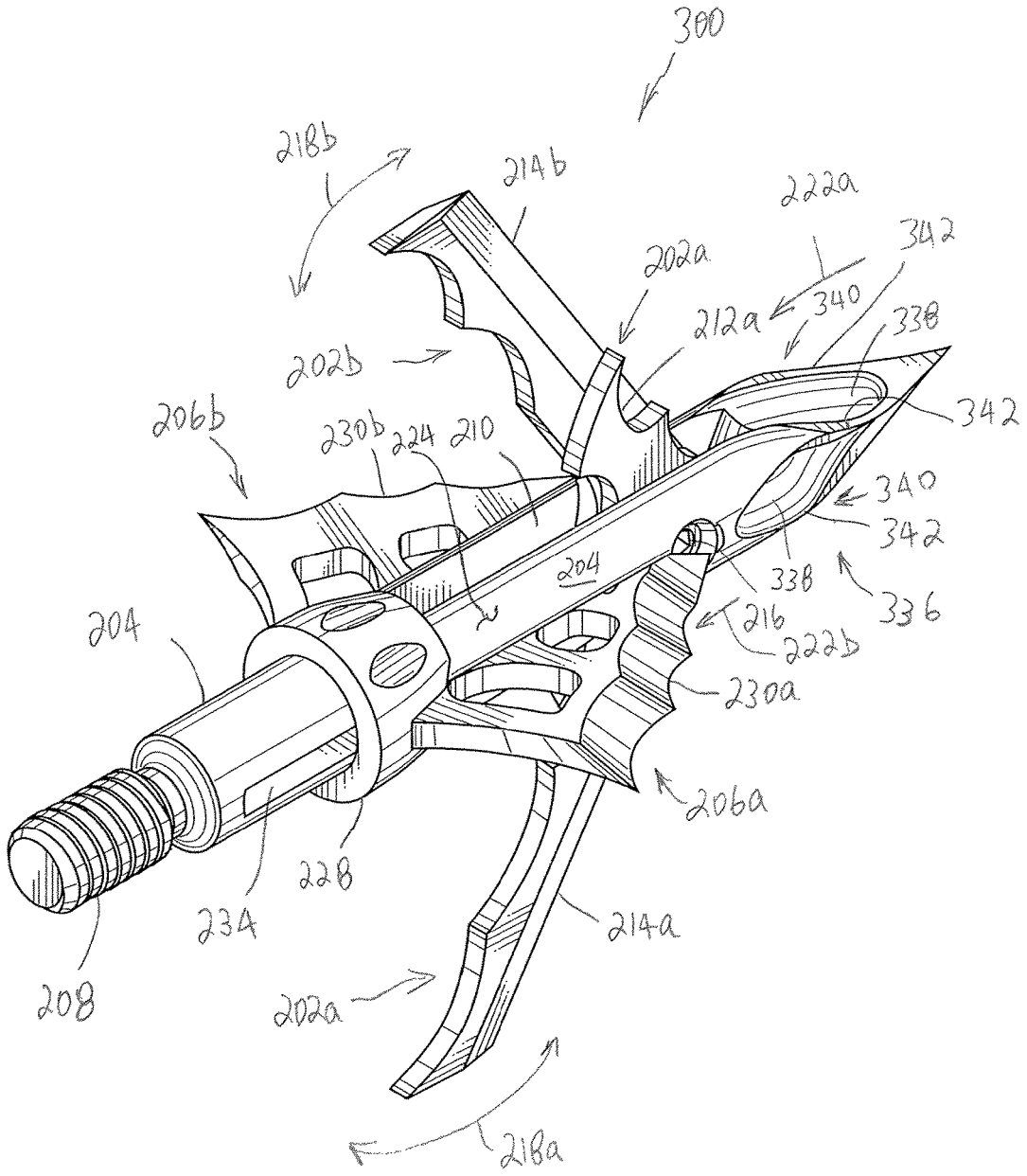
FIG. 6B is a perspective view of the broadhead of FIG. 6A with the deployable blades illustrated in a partially deployed (or partially extended) state.

FIGS. 6A and 6B are perspective views of a non-limiting exemplary embodiment of another broadhead 300. The broadheads 200 and 300 are substantially similar to each other in several aspects. As such, like elements of the broadheads 200 and 300 are designated with like reference numerals. The at least one difference between the broadheads 200 and 300, as will be described herein below, is the multi-faceted tip at their respective distal ends.

Figure 7:
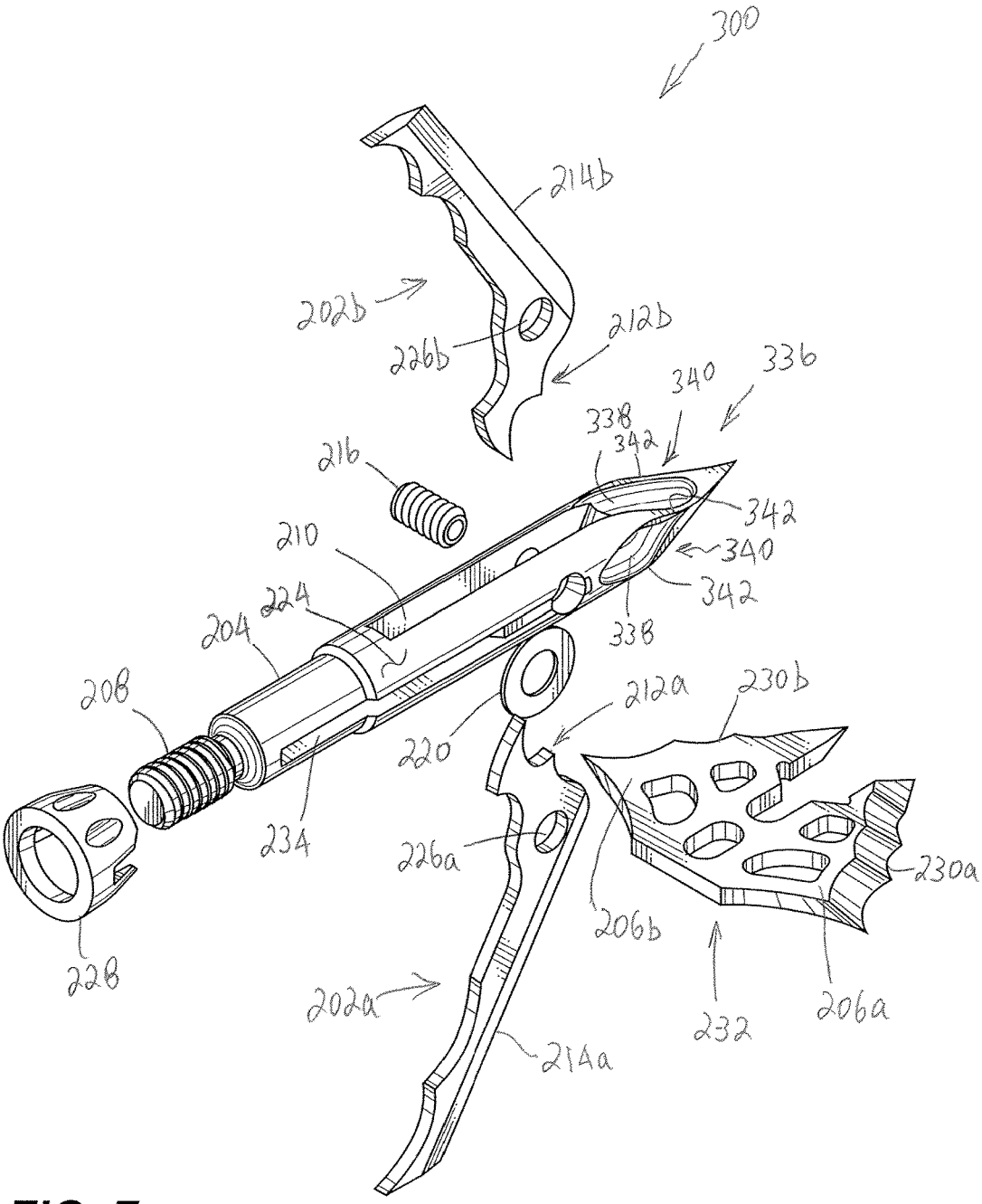
FIG. 7 is a perspective view of the broadhead of FIG. 6A in a dis-assembled state.
Figure 8A:
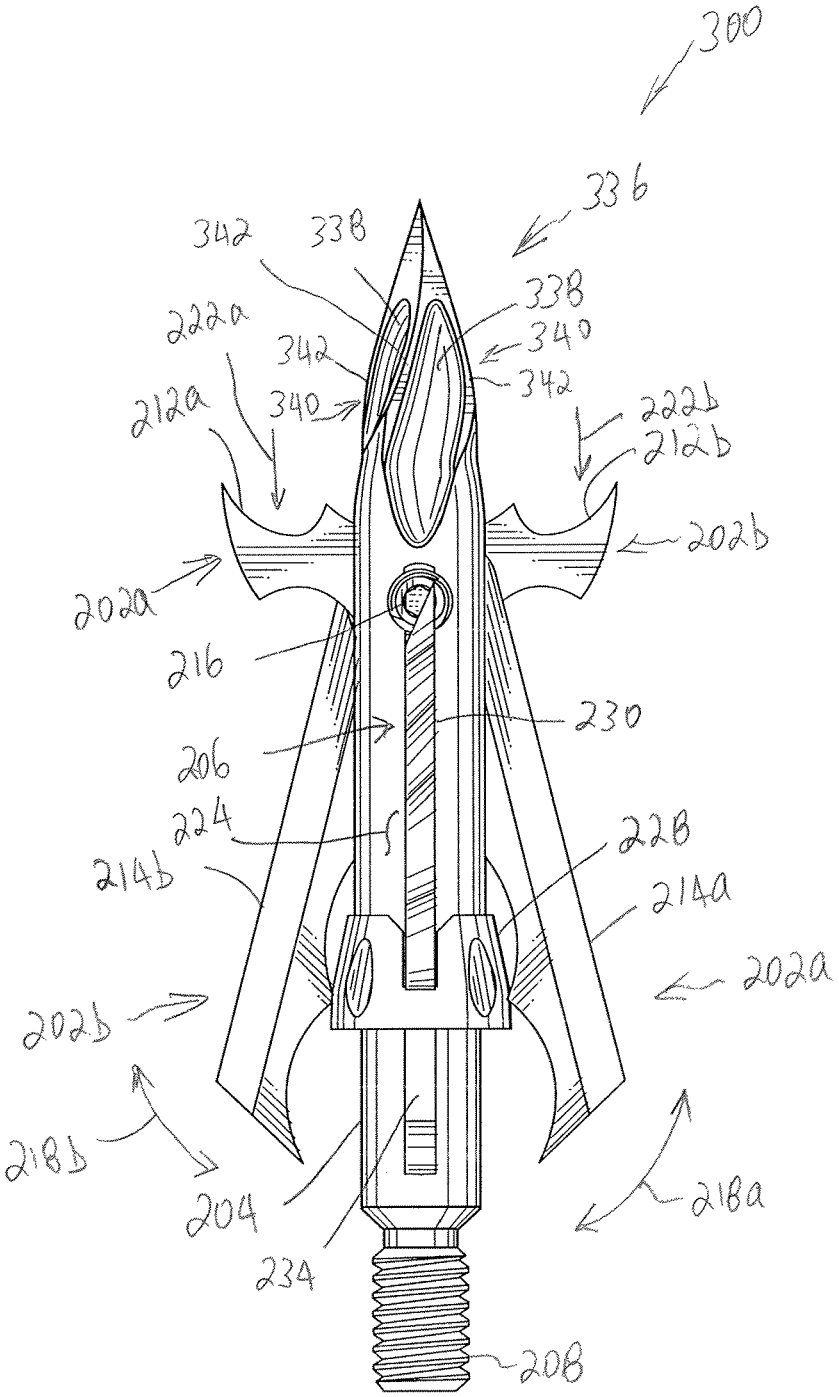
FIG. 8A is a side view of the broadhead of FIG. 6A.
Figure 8B:
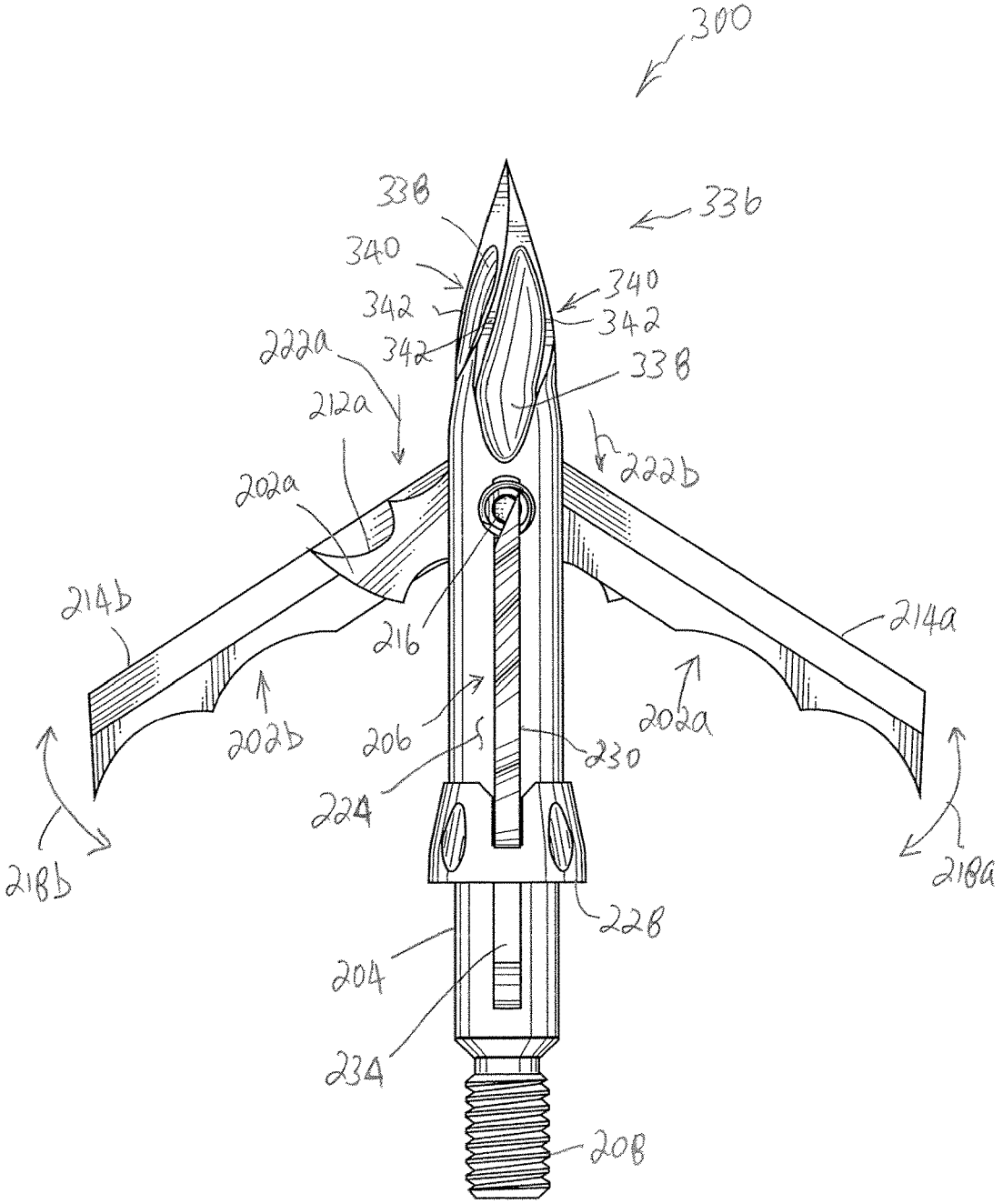
FIG. 8B is a side view of the broadhead of FIG. 6B.
Figure 8C:
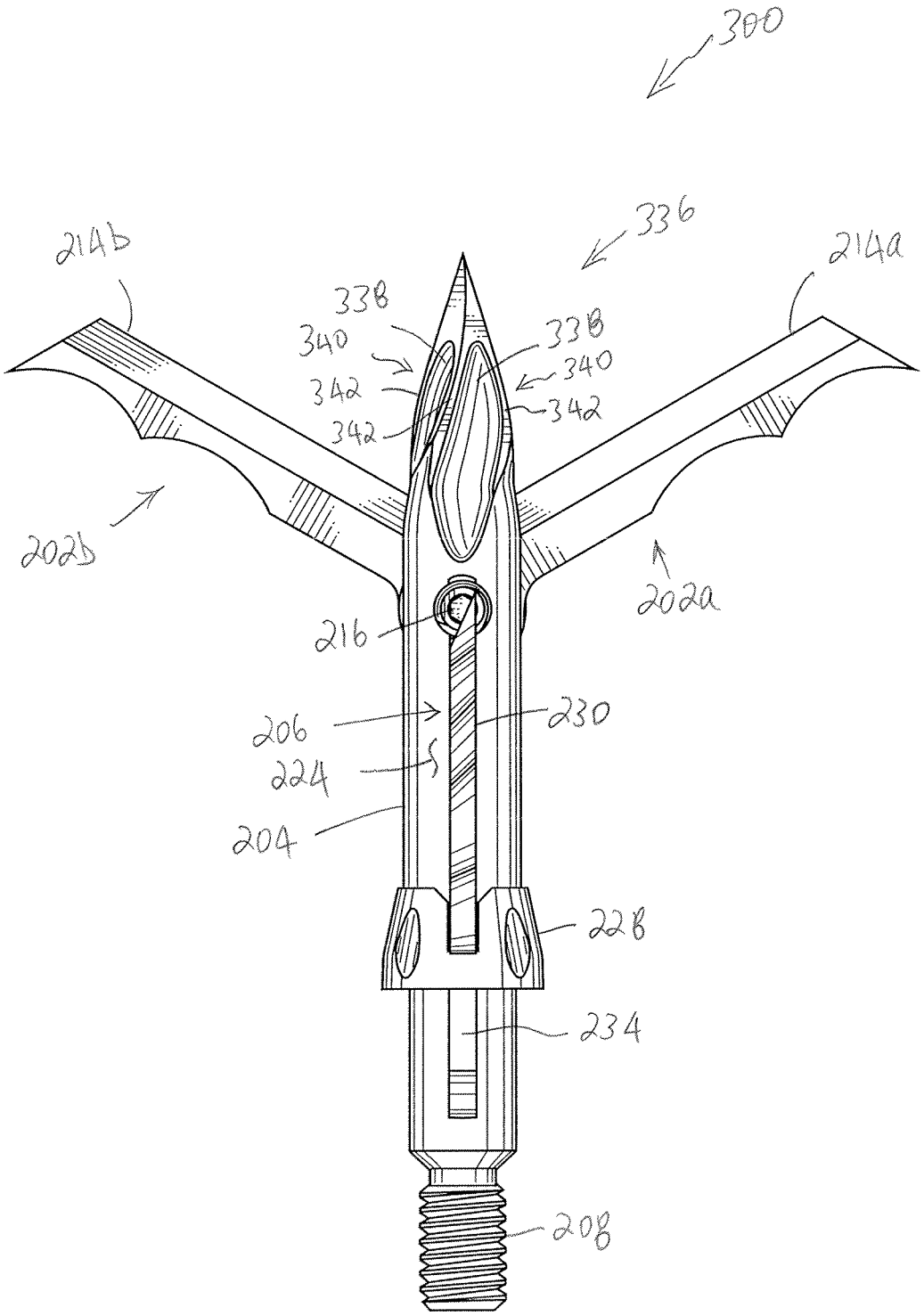
FIG. 8C is a side view of the broadhead of FIGS. 6A and 6B with the deployable blades illustrated in a fully extended state.
Figure 9:
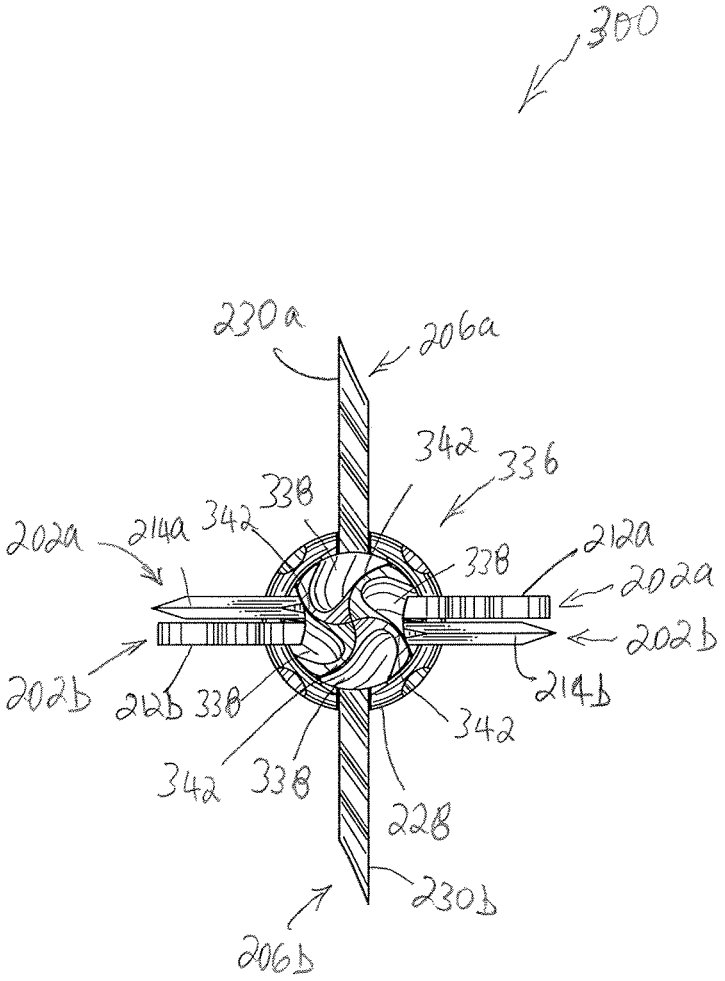
FIG. 9 is a front view of the broadhead of FIG. 6A.

FIG. 6A illustrates the broadhead 300 with deployable blades 202 in a fully retracted state; and FIG. 6B illustrates the broadhead 300 with the deployable blades 202 in a partially deployed (or partially extended) state. FIG. 7 is a perspective view of the broadhead 300 in a dis-assembled state illustrating non-limiting exemplary embodiments of some of the primary components thereof. FIGS. 8A-8C are side views of the broadhead 300 illustrating the deployable blades 202 in states or stages between fully retracted and fully extended (or fully deployed). FIG. 8A illustrates the broadhead 300 with deployable blades 202 in a fully retracted state; FIG. 8B illustrates the broadhead 300 with the deployable blades 202 in a partially deployed (or partially extended) state; and FIG. 8C illustrates the broadhead 300 with the deployable blades 202 in a fully extended (or fully deployed) state.

In non-limiting exemplary embodiments, each broadhead 200 and 300 includes a ferrule 204, one or more cutting blades 206, a plurality of deployable blades 202, and a threaded portion 208 for attaching the broadhead 200/300 to an arrow or bolt shaft (not shown).

It should be clearly understood that while only two deployable blades 202*a* and 202*b* are illustrated and described herein with reference to the figures, this should not be construed as an intent, implied or otherwise, to limit the instant disclosure to broadheads having only two deployable blades 202*a* and 202*b*. Alternate non-limiting embodiments of the broadheads 200 and 300 having more than two or having less than two deployable blades 202 are contemplated and are considered as being within the metes and bounds of the instant disclosure. Likewise, it should be clearly understood that while only two cutting blades 206*a* and 206*b* (collectively "cutting blades 206") are illustrated and described herein with reference to the figures, this should not be construed as an intent, implied or otherwise, to limit the instant disclosure to broadheads having only two cutting blades 206. Alternate non-limiting embodiments of the broadheads 200 and 300 having more than two or having less than two cutting blades 206 are contemplated and are considered as being within the metes and bounds of the instant disclosure.

In non-limiting exemplary embodiments, the ferrule 204 includes at least one blade recess 210. In certain embodiments, at least a portion of the blade recess 210 is configured for receiving or housing at least a portion of the deployable blades 202. In certain embodiments, the blade recess 210 is configured as a slot extending or traversing through the body of the ferrule 204. In some embodiments, at least a portion of the deployable blades 202 extends through the blade recess 210 and traverses the body of the ferrule 204. However, such configurations of the blade recess 210 should not be construed as an intent, implied or otherwise, to limit the instant disclosure. One or more alternate configurations for the blade recess 210, as will be apparent to a person of ordinary skill, are contemplated and are considered as being within the metes and bounds of the instant disclosure. For instance, in some embodiments, the ferrule 204 may have a varying number of blade recesses, each configured for housing at least a portion of one or more deployable blades 202.

In non-limiting exemplary embodiments, each deployable blade 202 is defined at least in part by a leading edge 212 and a cutting edge 214. With reference to the figures, the deployable blade 202*a* is defined at least in part by the leading edge 212*a* and the cutting edge 214*a*, and the deployable blade 202*b* is defined at least in part by the leading edge 212*b* and the cutting edge 214*b*. In some embodiments, a fastener (e.g., a screw, a pin, a threaded pin) 216 is used for rotatably attaching the deployable blades 202 to the ferrule 204. In certain embodiments, the fastener 216 defines a pivot point or an axis of rotation about which the deployable blades 202 rotate, as indicated by the directional arrows 218*a* and 218*b*, between the fully retracted state or stage and the fully extended (or fully deployed) state or stage. In some embodiments the fastener 216 can be operated to enable removal and/or replacement of the one or more deployable blades 202. In certain embodiments, a washer 220 is provided between the deployable blades 202*a* and 202*b* when attached to the ferrule 204. In some embodiments, the washer 220 is configured to enable unhindered rotation of the deployable blades 202 and to prevent or minimize the deployable blades 202 from sticking or binding with each other. In certain embodiments, one or more washers (not shown) are provided between one or both deployable blades 202 and the ferrule 204. It should be clearly understood that while only one fastener 216 is illustrated and described, this should not be construed as an intent, implied or otherwise, to limit the instant disclosure to only one fastener 216. In some embodiments, separate pins or fasteners or threaded pins are provided for rotatably attaching each individual deployable blades 202 to the ferrule 204.

In non-limiting exemplary embodiments, the leading edges 212 extend substantially orthogonally from the ferrule 204 when the deployable blades 202 are in a fully retracted state. However, this configuration should not be construed as a limitation. In some embodiments, the leading edges 212 may be at an acute and/or an obtuse angle relative to the ferrule 204 when the deployable blades 202 are in a fully retracted state. When the broadhead 200/300 impacts and starts penetrating a target (not shown), forces in the direction indicated by the arrows 222 act on the leading edges 212 causing the deployable blades 202 to extend (or deploy) from their respective fully retracted states by rotating about the axis of rotation defined by the fastener 216. For instance, the forces acting on the leading edges 212*a* and 212*b* will cause the deployable blades 202*a* and 202*b* to rotate about the axis of rotation defined by the fastener 216. In some embodiments, the deployable blades 202 will continue to rotate while any portion of the leading edges 212 remains exposed or extended from the exterior surface 224 of the ferrule 204. In certain embodiments, the deployable blades 202 will rotate until no portion of the leading edges 212 is exposed or extended from the exterior surface 224 of the ferrule 204 as exemplified in FIGS. 4C and 8C. In some embodiments, the ferrule 204 is configured for housing the leading edges 212 in their entirety while the deployable blades 202 are in the fully extended state.

In non-limiting exemplary embodiments, the fastener 216 extends through the holes 226*a* and 226*b* in respective deployable blades 202*a* and 202*b*. In some embodiments, the deployable blades 202 rotate about the fastener 216 without any longitudinal translation or movement.

In non-limiting exemplary embodiments, the broadheads 200/300 include a retaining device 228 configured for retaining the deployable blades 202 in a retracted state during flight until impact. In some embodiments, the retaining device 228 is a collar as is well known in the art. In certain embodiments, the retaining device 228 includes frangible tabs (not shown) that retain the deployable blades 202 in a retracted state during flight, and shatter or break off when the deployable blades 202 start deploying or extending from the fully retracted state. In some embodiments, the retaining device 228 is a shock-absorbing device. In certain embodiments, the retaining device 228 is an O-ring. In some embodiments, the retaining device 228 is composed of an elastic material. It should be well understood that there is no intent, implied or otherwise, to limit the type or configuration of the retaining device 228 to those illustrated and/or described. Various non-limiting exemplary embodiments of retaining devices are disclosed in U.S. Pat. Nos. 8,758,176, and 8,986,141 which are herein incorporated by reference in their entirety.

In some embodiments, at least a portion 230 of each cutting blade 206 is configured as a cutting edge. In certain embodiments, the cutting blades 206 are configured as a single unitary component. One such single unitary component 232 having the cutting blades 206 is exemplified in FIGS. 3 and 7. As illustrated, the ferrule 204 includes a slot 234 through which at least a portion of the single unitary component 232 extends such that the cutting edges 230 of the cutting blades 206 are disposed on opposite sides of the ferrule 204. In some non-limiting exemplary embodiments, the unitary component 232 having the cutting blades 206 is replaceable in its entirety. In certain non-limiting exemplary embodiments, the cutting blades 206*a* and 206*b* are discrete components attached on opposite sides of the ferrule 204. In some embodiments, one or more of the cutting blades 206 are replaceable.

Figure 1:
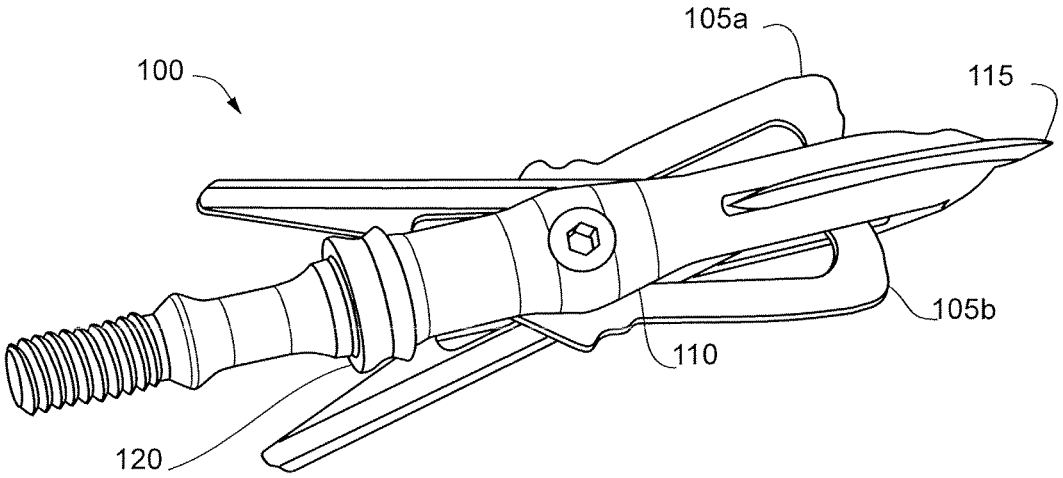
FIG. 1 PRIOR ART
FIG. 1 is a perspective view of an embodiment of a prior art broadhead.

In non-limiting exemplary embodiments, the broadheads 200 and 300, respectively, include multi-faceted tips 236 and 336 at the distal end of their respective ferrule 204. In some embodiments, the multi-faceted tips 236 and/or 336 are formed integrally with their respective ferrule 204. In certain embodiments, the multi-faceted tips 236 and/or 336 are discrete components that are fixedly or removably attached to their respective ferrule 204. In some embodiments, the multi-faceted tips 236 and/or 336 are replaceable. In contrast to the "scalpel" or "cut-on-contact" arrowhead tip 115 illustrated in FIG. 1, the multi-faceted tips 236 and 336, in some embodiments, result in broadheads 200 and 300 having a center-of-mass located forward of center. In some embodiments, such offset of the center-of-mass improves the in-flight characteristics and aerodynamics of the broadhead. Additionally, or in the alternative, and in contrast to the tip 115, the multi-faceted tips 236 and 336, in some embodiments, reduce the broadhead's susceptibility to impact damage caused by hard structures, e.g., bone, in a target. In non-limiting exemplary embodiments, the multi-faceted tips 236 and 336 are coated with a material selected from the group consisting of nickel, zinc, cadmium, and black oxide. Additionally, or in the alternative, the multi-faceted tips 236 and 336, in some embodiments, are coated with a friction reducing coating such as a PTFE-impregnated ceramic or fluoropolymer or other ceramic coating.

In non-limiting exemplary embodiments, the multi-faceted tip 236 is defined at least in part by two or more facets 238 and at least one ridge 240 between adjacent facets 238. Likewise, in non-limiting exemplary embodiments, the multi-faceted tip 336 is defined at least in part by two or more facets 338 and at least one ridge 340 between adjacent facets 338. In certain embodiments, one or more upper edges 242 and 342 of respective ridges 240 and 340 are configured as a cutting edge.

In some non-limiting exemplary embodiments, the surfaces of one or more facets 238 and 338 is substantially planar or flat along their longitudinal extent. In certain non-limiting exemplary embodiments, the surfaces of one or more facets 238 and 338 is configured as a longitudinally extending channel defined at least in part by respective adjacent ridges 240 and 340. It should be clearly understood that the illustrated and/or described shapes or forms of the surfaces of the facets 238 and 338 are exemplary and should not be construed as limiting. In some embodiments, the surfaces of the facets 238 and 338 may be curved or concave along their respective longitudinal extent. In some embodiments, the concavity of the surfaces of the facets 238 and 338 increases the acuteness of the angle of the ridges 240 and 340 between adjacent facets 238 and 338. In certain embodiments, the concavity of the surfaces of the facets enhances the sharpness of the cutting edges between adjacent facets 238 and 338. In some embodiments, the concavity of the surfaces of the facets enhances the penetration of the broadheads 200/300. In some embodiments, the facets 238 and 338 may have a combination of surfaces that are substantially planar or flat along their longitudinal extent, surfaces that are configured as a longitudinally extending channel, and surfaces that are curved or concave. It should be clearly understood that any and all alternate shapes, forms, combinations, etc., that may become apparent to a person of ordinary skills, are considered encompassed within the metes and bounds of the instant disclosure.

In some non-limiting exemplary embodiments, the ridges, for example ridges 240, are substantially straight or linear along their longitudinal extent. Consequently, the facets 238 also will be substantially straight or linear along their longitudinal extent. In certain embodiments, wherein one or more of the facets 238 are configured as a channel, the multi-faceted tip 236 will have substantially straight longitudinally extending channels defined at least in part by consecutive or adjacent ridges 240. However, the ridges are not required to be straight. In some non-limiting exemplary embodiments, the ridges, for example ridges 340, are curvilinear or helical along their longitudinal extent. Consequently, the multi-faceted tip 336 of the broadhead 300 will have curvilinear or spiraling cutting edges between adjacent facets 338. The facets 338 also will be curvilinear or helical along their longitudinal extent. In certain embodiments, wherein one or more of the facets 338 are configured as a channel, the multi-faceted tip 336 will have longitudinally extending curvilinear or helical channels defined at least in part by consecutive or adjacent ridges 340. Again, the ridges are not required to be curvilinear or helical. In some non-limiting exemplary embodiments, two consecutive or adjacent ridges may be serpentine. Consequently, any longitudinally extending channels on the surfaces of the facets will also be serpentine.

In certain embodiments, the multi-faceted tip 336 is configured to direct air flow around the body of the broadhead 300. In some embodiments, the pattern of the multi-faceted tip 336 is configured for increasing the rotation of the broadhead 300 during flight. In certain embodiments, the pattern of the multi-faceted tip 336 is configured for reducing the impact of cross-winds on the broadhead 300 during flight. As will be apparent to one skilled in the art, the patterns of the facets 338 and/or the ridges 340, individually or in any combination, may be configured to improve the flight characteristics, and possibly the accuracy and precision, of the broadhead 300. In some embodiments, the multi-faceted tip 236 and/or 336 is configured for reducing or minimizing the drag on the broadhead during flight. In certain embodiments, the multi-faceted tip 236 and/or 336 is configured for reducing or minimizing effect of cross-wind on the broadhead during flight.

In some non-limiting exemplary embodiments, the at least one blade recess 210 may be configured for releasing fluid pressure that may accumulate in front of the broadhead 200/300 as it penetrates a target. In certain embodiments, one or more of the at least one blade recess 210 of the broadhead 200 and at least one of the facets 238 of the multi-faceted tip 236 are contiguous. In some embodiments, one or more of the at least one blade recess 210 of the broadhead 200 and the channel on the one or more facets 238 are contiguous. In certain embodiments, one or more of the at least one blade recess 210 of the broadhead 300 and at least one of the facets 338 of the multi-faceted tip 336 are contiguous. In some embodiments, one or more of the at least one blade recess 210 of the broadhead 300 and the channel on the one or more facets 338 are contiguous.

In non-limiting exemplary embodiments, offsetting the deployable blades 202 and/or the cutting blades 206 and/or the ridges 240/340 enhances the cutting and/or penetration ability of a broadhead. In some non-limiting exemplary embodiments, the deployable blades 202 and the cutting blades 206 are offset from each other. In certain non-limiting exemplary embodiments, the deployable blades 202 and the ridges 240/340 are offset from each other. In some non-limiting exemplary embodiments, the cutting blades 206 and the ridges 240/340 are offset from each other. In certain non-limiting exemplary embodiments, the deployable blades 202, the cutting blades 206, and the ridges 240/340 are offset from one another. In some non-limiting exemplary embodiments, any two of the deployable blades 202, the cutting blades 206, and the ridges 240/340 may be aligned with each other and offset from the third. For instance, in certain exemplary embodiments, the deployable blades 202 and the ridges 240/340 may be aligned with each other but offset from the cutting blades 206. In some embodiments, the cutting blades 206 and the ridges 240/340 may be aligned with each other but offset from the deployable blades 202. All different arrangements of the deployable blades 202, the cutting blades 206, and the ridges 240/340 are considered as being within the metes and bounds of the instant disclosure.

In non-limiting exemplary embodiments, offsetting the deployable blades from one or both the cutting edges and the fixed cutting blades enhances the deployment of the deployable blades when the leading edges of the deployable blades strike or impact the target while the deployable blades are in their retracted configuration. In certain embodiments, such offsetting of the deployable blades ensures that they fully deploy to expose the sharp cutting edges when the leading edges of the deployable blades strike or impact the target.

It should be clearly understood that is no intent, implied or otherwise, to limit the number and disposition (or positioning or placement) of the deployable blades, the cutting blades, and the ridges on the multi-faceted tip only to those illustrated and/or described herein with reference to the figures. While the figures illustrate the broadheads 200 and 300 having two deployable blades 202*a* and 202*b*, two fixed cutting blades 206*a* and 206*b*, and four ridges 240*a*-240*d* and 340*a*-340*d* on respective multi-faceted tips 236 and 336, this design and/or configuration should not be construed as limiting. In non-limiting exemplary embodiments, the number of deployable blades 202, the number of fixed cutting blades 206, and the number of ridges 240 and 340 on the respective multi-faceted tip 236 and 336 are a multiple of one another. For instance, in some exemplary embodiments, the broadheads 200 and/or 300 may include two deployable blades, four fixed cutting blades, and six ridges on the multi-faced tips. In certain exemplary embodiments, the broadheads 200 and/or 300 may include three deployable blades, three or six fixed cutting blades, and three or six ridges on the multi-faced tips. In some non-limiting exemplary embodiments, the number of ridges on the multi-faced tips may be a multiple of the number of deployable blades. In certain non-limiting exemplary embodiments, the number of fixed cutting blades may be a multiple of the number of deployable blades. In some non-limiting exemplary embodiments, the number of ridges on the multi-faced tip may be a multiple of the number of fixed cutting blades. In general, the number of any one or more of the deployable blades, the fixed cutting blades, and the cutting edges may be a multiple of any one or more of the others. Of course, as has been described, the upper edges of one or more of the ridges can be configured as a cutting edge.

In non-limiting exemplary embodiments having a cutting edge on each of two deployable blades and having a cutting edge on each of four fixed cutting blades, the fixed cutting blades may be positioned to trisect the separation angle between the two deployable blades, such that the six cutting edges, viz., two on the deployable blades and four on the fixed cutting blades, are evenly spaced around the broadhead. In some embodiments having a cutting edge on each of three deployable blades and a cutting edge on each of three fixed cutting blades, each fixed cutting blade may be positioned to bisect a separation angle between adjacent deployable blades. Of course, as has been described, the broadhead may further include a multi-faceted tip with a plurality of ridges between adjacent facets (or ridges defined at least in part by adjacent facets). As has also been described, the upper edge of one or more of the plurality of ridges may be configured as a cutting edge.

Additional and/or alternate exemplary embodiments and further detailed descriptions pertaining to the structural and functional characteristics of broadheads having deployable blades, fixed cutting blades, multi-faceted tips, retaining devices, etc., are disclosed in Applicant's U.S. Pat. Nos. 8,197,367, 8,986,141 and 9,404,722 which are hereby incorporated by reference in their entirety.

In view thereof, modified and/or alternate configurations of the embodiments described herein may become apparent or obvious to one of ordinary skill. All such variations are considered as being within the metes and bounds of the instant disclosure. For instance, while reference may have been made to particular feature(s) and/or function(s), the disclosure is considered to also include embodiments configured for functioning and/or providing functionalities similar to those disclosed herein with reference to the accompanying drawings. Accordingly, the spirit, scope and intent of the instant disclosure is to embrace all such variations. Consequently, the metes and bounds of the disclosure is solely defined by the appended claims and any and all equivalents thereof.

What is claimed is:

1. A broadhead, comprising:

a ferrule, comprising:

a multi-faceted tip; and at least one blade recess;

one or more cutting blades attached to the ferrule; and a plurality of deployable blades rotatably attached to the ferrule, each deployable blade comprising:

a leading edge; and a sharp cutting edge;

wherein, at least one facet of the multi-faceted tip and the at least one recess are contiguous; and at least a portion of each deployable blade resides in at least a portion of the at least one blade recess.

2. The broadhead of claim 1, comprising a retaining device for releasably retaining the deployable blades in a retracted configuration until impact.

3. The broadhead of claim 1, wherein the cutting blades and the deployable blades are offset from each other.

4. The broadhead of claim 1, wherein the number of cutting blades and the number of deployable blades are a multiple of each other.

5. The broadhead of claim 1, wherein the multi-faceted tip comprises one or more ridges disposed between adjacent facets.

6. The broadhead of claim 5, wherein an upper edge of each ridge is a cutting edge.

7. The broadhead of claim 5, wherein the one or more ridges are one of a straight line and a curvilinear line.

8. The broadhead of claim 5, wherein the ridges and the cutting blades are offset from each other.

9. The broadhead of claim 5, wherein the ridges and the deployable blades are offset from each other.

10. The broadhead of claim 5, wherein the ridges, the cutting blades, and the deployable blades are offset from one another.

11. The broadhead of claim 5, wherein the number of ridges and the number of cutting blades are a multiple of each other.

12. The broadhead of claim 5, wherein the number of ridges and the number of deployable blades are a multiple of each other.

13. The broadhead of claim 5, wherein the number of ridges, the number of cutting blades, and the number of deployable blades are a multiple of one another.

14. The broadhead of claim 1, wherein the multi-faceted tip comprises a helical pattern having spiraling ridges between adjacent facets.

15. The broadhead of claim 1, wherein the ferrule is configured for relieving fluid pressure.

16. The broadhead of claim 1, wherein at least one facet of the multi-faceted tip comprises a channel.

17. The broadhead of claim 16, wherein the channel and the at least one recess are contiguous.

18. The broadhead of claim 16, wherein the channel is curved.

19. The broadhead of claim 16, wherein the channel is serpentine.

20. The broadhead of claim 16, wherein the channel is substantially straight.

21. The broadhead of claim 1, comprising a center of mass distal of a center of the broadhead.

22. The broadhead of claim 1, configured for one or more of:

increasing rotation of the broadhead;

reducing drag; and reducing the effect of cross-wind.

23. The broadhead of claim 1, wherein the deployable blades are replaceable.

24. The broadhead of claim 1, wherein the cutting blades are replaceable.

25. The broadhead of claim 1, wherein the multi-faceted tip is replaceable.

26. The broadhead of claim 1, wherein the cutting blades comprise a sharp cutting edge.

* * * * *